United States Patent [19]

Thomas

[11] B 4,000,638

[45] Jan. 4, 1977

[54] PLATE MILL FINISHING STAND ROLL LATCH RING

[75] Inventor: McKinley B. Thomas, Orem, Utah

[73] Assignee: United States Steel Corporation, Pittsburgh, Pa.

[22] Filed: Mar. 31, 1975

[21] Appl. No.: 563,932

[44] Published under the second Trial Voluntary Protest Program on March 23, 1976 as document No. B 563,932.

[52] U.S. Cl. ..... 72/238

[51] Int. Cl.[2] ..... B21B 31/08

[58] Field of Search ..... 72/238, 249, 239, 237; 403/373

[56] References Cited

UNITED STATES PATENTS

| | | | |
|---|---|---|---|
| 2,774,263 | 12/1956 | Leufren | 72/238 |
| 2,927,488 | 3/1960 | Petereit | 72/238 |
| 3,508,426 | 4/1970 | Maltby | 72/238 |

*Primary Examiner*—Milton S. Mehr
*Attorney, Agent, or Firm*—William A. Danchuk

[57] ABSTRACT

A latch ring, chock and drive pod retainer assembly ideally suited for use with a finishing stand roll having a chock located at each of its ends, a drive pod at one of its ends, and a circumferal groove formed at each of its ends. The latch ring assembly is employed for retaining the chocks and the drive pod on their respective ends of the roll. The latch ring assembly includes a plurality of latching arms pivotally mounted within a generally toroidal shaped housing, the latching arms being movable between a latched position, in which the latching arms engage the circumferal groove of the roll, and an unlatched position, in which the latching arms are retracted within the assembly housing to a position in which they are out of engagement with the finishing roll circumferal groove. The assembly is configured such that the latching arms are biased toward their latched positions, the assembly also having a mechanism which is operated to retain the latching arms in their unlatched position for facilitating removal of the latch assembly from the roll when it is desired to remove the drive pod and chocks therefrom.

9 Claims, 6 Drawing Figures

58
64
62
70
82
94
92
86
10
54
28d
28a
18d
18a
46
78
40
c.g.
c.g.
20d
20a
74
120
6
3
4
24d
36
24a
22d
30d
22a
30a
12
22c
32d
16
14
32a
22b
48
38
2
34
2
32c
32b
24c
24b
44
42
3
72
30c
36
30b
18c
c.g.
c.g.
18b
20b
20c
76
28c
28b
56
70
62
84
88
90
64
60
80

PLATE MILL FINISHING STAND ROLL LATCH RING

BACKGROUND OF THE INVENTION

The present invention is addressed to a work roll latch ring assembly ideally suited for a plate mill finishing stand roll. The work rolls in a finishing stand for a plate mill are relatively large (approximately 30 inches in diameter), and relatively long (20 to 21 feet), such that they must be supported at their ends by a chock assembly which contains the bearings that support the roll as it turns. One end of the roll extends through the chock and is necked down further and has two parallel flats to receive a drive pod. The drive pod is part of the coupling from the power source which is used to drive the roll. Split ring assemblies are currently employed to retain the chock on the roll and a quarter-turn pin is employed to retain the pod on the roll.

The rolling of hot steel in a plate mill finishing stand requires that the rolls in the stand must be periodically removed from the finishing stand and be reground, due to the wear that occurs. During such regrinding, the chocks and pod must be removed from the roll after it is removed from the finishing stand before the roll can be reground. Removal of the chocks and pod from the roll is accomplished in the following manner. The roll is removed from the stand and the drive pod is removed from the roll using a crane. The chocks are then in a position in which they may be removed from the roll prior to regrinding. However, before the chocks can be removed, it is necessary for several men to manually release the split rings and pull ring assembly, which retain the chocks on the roll. Special slings are required and considerable time is lost in this method of removal. Additionally, the employment of heavy parts in this manner necessitates a high degree of caution due to pinch points and bumping problems associated with heavy machinery. It would be most advantageous in this regard to minimize the direct handling of pieces and parts in order to lessen the possibility of injury and damage to the component pieces and personnel.

SUMMARY OF THE INVENTION

The present invention is addressed to a latch ring assembly for retaining both clock bearings and a roll drive pod on a finishing stand roll.

In one preferred embodiment, the invention is employed in conjunction with a finishing stand roll having a circumferal groove formed about its ends, the latch ring assembly being engageable with the circumferal groove of the roll for retaining both the chocks and the drive pod on the roll. The latch ring assembly provides for the convenience and efficient removal of the chocks and drive pod from the roll prior to regrinding.

A generally toroidal shaped housing is provided to which a plurality of latching arms are mounted. The latching arms are pivotally movable, through a pin mounting arrangement, between a first position, in which a portion of the latching arms extends inwardly of the inner diameter of the housing to engage the circumferal groove on the roll, and an unlatched position, in which the circumferal groove engaging portion of the latching arms is retracted within the housing and out of engagement with the circumferal groove of the roll, thereby facilitating removal of the latch ring assembly from the roll. The latching arms are movable from their latched positions to their unlatched positions in response to the introduction of an external actuating member into a pre-selected portion of the housing. Extension springs are provided within the latch ring assembly for biasing the latching arms into their latched positions for the proper functioning of the latch ring assembly during rotation of the roll.

The latching arms of the latch ring assembly are pivotally mounted in such a manner that the pivot for each of the latching arms is located between the circumferal groove engaging portion of the latching arm and the latter's center of gravity. Consequently, each of the circumferal groove engaging portions is moved into deeper engagement with the roll's circumferal groove when the roll and the latch ring assembly are rotated. As a result, the latch ring assembly provides a more efficient latching of the chocks and drive pod, especially when the stand roll is rotating.

One object and feature of the present invention is to provide a latch ring assembly for locking specific elements to a normally rotating roll.

Another object and feature of the present invention is to provide a latch ring assembly for a finishing stand roll having a circumferal groove formed therein, the latch ring assembly being operative to lock both rotational chocks and a drive pod to the stand roll both before and during the latter's rotation, the latch ring assembly being configured such that its holding power is increased as the roll's rotational speed is increased.

Still a further object and feature of the present invention is to provide a latch ring chock and drive pod retainer assembly for a finishing stand roll having a circumferal groove formed therein, the latch ring assembly being operative to retain both bearing containing chocks and roll drive pod to the roll during the latter's rotation, the latch ring assembly including a plurality of latching arms pivotally mounted to a latch ring assembly housing, the latching arms being pivotally movable between a latched position, in which the latching arms engage the circumferal groove of the stand roll, and an unlatched position, in which the latching arms retracted out of engagement with the roll groove.

Other objects and features of the invention will, in part, be obvious and will, in part, appear hereinafter.

The invention accordingly comprises the apparatus possessing the construction, combination of elements, and arrangement of parts which are exemplified in the following detailed disclosure, and the scope of the application which will be indicated in the claims.

BRIEF DESCRIPTION OF THE DRAWINGS

For a fuller understanding of the nature and objects of the invention, reference should be made to the following detailed description taken in connection with the accompanying drawings, wherein.

DETAILED DESCRIPTION OF THE INVENTION

Figure 1:
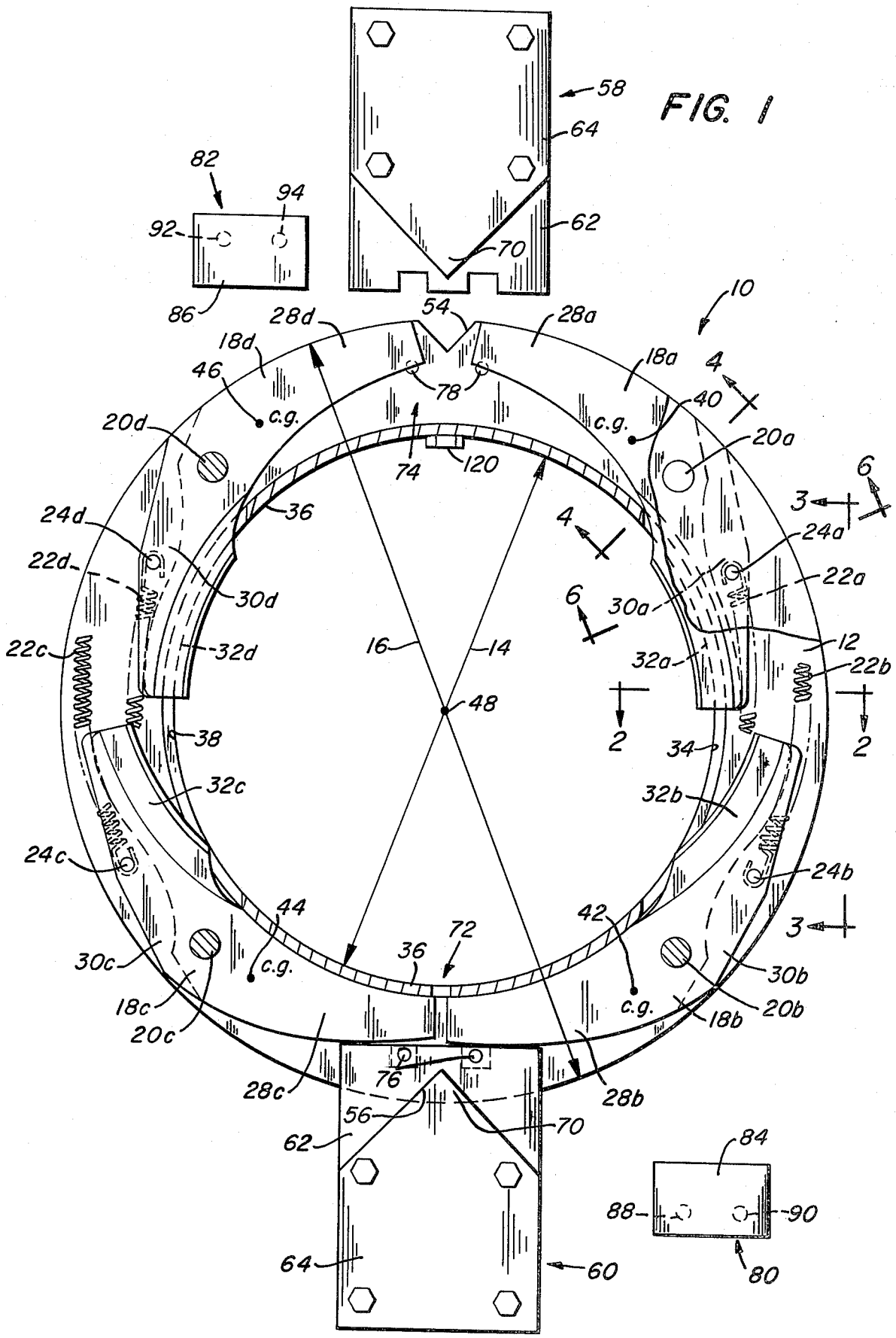
FIG. 1 is an end elevational view of a latch ring assembly according to a preferred embodiment of the invention with portions broken away to reveal internal structure.
Figure 2:
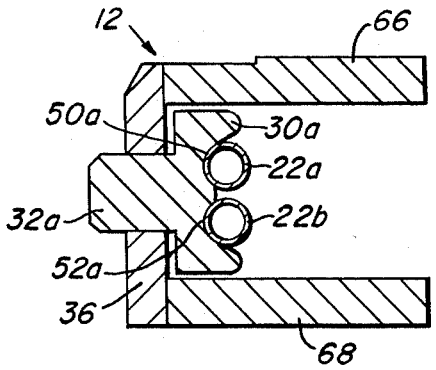
FIG. 2 is a sectional view of the latch ring assembly of FIG. 1 taken through the lines 2—2.
Figure 4:
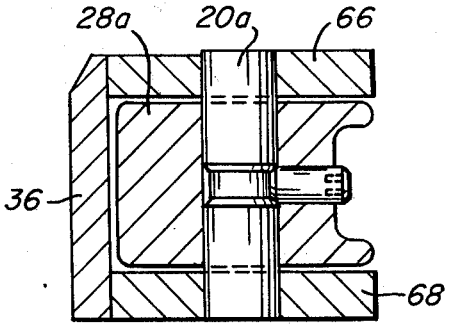
FIG. 4 is another sectional view of the latch ring assembly of FIG. 1 taken through the lines 4—4.

Referring to FIG. 1, a latch ring assembly according to the present invention is illustrated generally at 10. The latch assembly 10 includes a toroidal shaped housing 12 having an inner diameter 14 and an outer diameter 16. Housing 12 is configured having a generally C-shaped cross-section with the open end directed outwardly. The specific cross-sectional configuration of the latch assembly housing 12 may be best seen by referring to FIGS. 2 and 4. The specific purpose of the above-noted configuration will be discussed in further detail below.

Mounted within housing 12 are four physically independent latching arms 18*a*, 18*b*, 18*c* and 18*d*. The latching arms 18*a*–18*d* are mounted within housing 12 upon pins 20*a*, 20*b*, 20*c* and 20*d*, respectively, for pivotal movement between latched and unlatched positions. In this regard, it should be noted that latching arms 18*a* and 18*d* are located in their latched positions (as seen in FIG. 1), while latching arms 18*b* and 18*c* are located in their respective unlatched positions. As will be elucidated below, arms 18*a* and 18*d* are simultaneously movable from their respective latched positions to their respective unlatched positions in response to the introduction of an external actuating member. Correspondingly, latching arms 18*b* and 18*c* are movable together from their respective latched positions to their respective unlatched positions in response to the introduction of a second external actuating member.

The latching arms 18*a–d* are biased toward their latched positions through the employment of two pairs of extension springs 22*a* and 22*b*, and 22*c* and 22*d*. The first pair of springs 22*a* and *b* are associated with arms 18*a* and 18*b*, while the second pair of springs 22*c* and *d* are associated with arms 18*c* and 18*d*. The springs 22*a* and 22*b* extend between arms 18*a* and *b* and are attached to the arms through pins 24*a* and 24*b*, respectively. In similar fashion, springs 22*c* and *d* extend between arms 18*c* and 18*d* and are attached to the arms through pins 24*c* and 24*d*, respectively.

Figure 6:
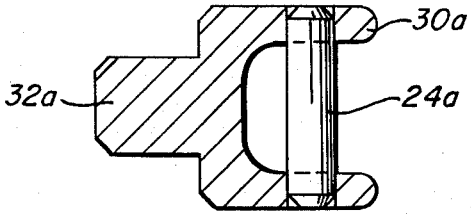
FIG. 6 is a sectional view of the latching arm only of FIG. 1 taken through lines 6—6.

Referring to FIGS. 1 and 6, the specific configuration of the latching arms 18*a–d* will be explained. Inasmuch as the latching arms 18*a–d* are similar, only one, i.e., 18*a*, will be explained in detail. The details of the remaining arms 18*b–d* should be obvious from the following discussion, wherein each arm has associated subscripted letters related to its individual elements which will be explained with regard to latching arm 18*a*.

Latching arm 18*a*, as well as the remaining latching arms 18*b–d*, is configured having a curved shape. The latching arm is pivoted substantially at its center about the pivot pin 20*a* which extends through the C-shaped cross-section of housing 12 (see FIG. 4). The arm 18*a* includes a solid actuation portion 28*a*, a U-shaped portion 30*a*, through which pin 24*a* extends, and a roller engaging portion 32*a* which is configured to extend through an aperture 34 formed in an inner wall 36 of housing 12. Aperture 34 provides an inner diameter opening for the roller engaging portions 32*a* and 32*b* of latching arms 18*a* and 18*b*, respectively. In a similar manner, an aperture 38, located on the opposite side of the inner wall 36 from aperture 34 provides a means through which roller engaging portions 32*c* and 32*d* of arms 18*c* and 18*d*, respectively, may extend inwardly of the inner diameter 14 defined by inner wall 36 when the latching arms 18*c* and *d* are in their latched positions.

As noted above, latching arm 18*a* is mounted for pivotal movement about the pivot pin 20*a*. The latching arm 18*a*, as well as all of the remaining latching arms 18*b*–18*d*, is mounted for pivotal movement through the substantial physical center of the arm. However, the specific configuration of the arm 18*a* is such that the center of gravity of arm 18*a* is located at a point 40 dislocated from the substantial physical center of the arm at pin 20*a*. Likewise, the center of gravity of latching arms 18*b*, 18*c* and 18*d* are located at the respective points 42, 44, and 46, all of which are dislocated from their rotational centers 20*b*, 20*c*, and 20*d*, respectively. The specific dislocation of the centers of gravity of the latching arms from their centers of rotation is a deliberate design modification relating to the holding efficiency of the latch assembly. Specifically, the latch assembly 10 is designed to rotate at relatively high rates when it is in operation on the mill roll. The rotation of the latch assembly in either direction about its center 48 results in a centrifugal force being applied to the centers of gravity of all the latching arms, which in turn, tends to force the centers of gravity of arms 18*a* and 18*c* outwardly in a clockwise direction about their respective pivot pins 20*a* and 20*c*, and the centers of gravity of arms 18*b* and 18*d* outwardly in a counterclockwise direction about their respective pivot pins 20*b* and 20*d*. The above-noted action tends to force the roller enagaging portions 32*a–d* of latching arms 18*a–d* toward the center 48 of the latch assembly 10, thereby creating an increased holding force between the latch assembly and the roller. It should be noted that the location of the pivot for the latching arm between the roller engaging portion 32 of the arm and the arm's center of gravity is the principle cause of the above-noted operation. A relocation of the arm's pivot point to the arm's center of gravity or to a location between the pivot point and the roller engaging portion of the arm would destroy the operation just explained.

As previously noted, the two pairs of extension springs 22*a* and *b* and 22*c* and *d* extend between the arms 18*a* and *b* and 18*c* and *d*, respectively, and function to bias the latching arms toward their latched positions, as exemplified by arms 18*a* and 18*d* in FIG. 1. The unlatched position of an arm is exemplified by the arms 18*b* and 18*c*. The spring 22*a* is partially shown in a latching arm "latched" position, while spring 22*b* is in a latching arm "unlatched" position. The springs 22*a* and 22*b*, in extending between pins 24*a* and 24*b*, pass through appopriately shaped indentations 50*a* and 52*a* and 50*b* and 52*b* formed in the U-shaped portions 30*a* and 30*b* of arms 18*a* and 18*b*, respectively. An example of their exact configuration may be best seen by referring to FIG. 2. Although not specifically illustrated, arms 18*c* and 18*d* also have identically formed spring indentations for facilitating the extension of springs 22*c* and *d* between pins 24*c* and 24*d*.

Located at the "top" and "bottom" of housing 12 are notches 54 and 56, respectively. Notches 54 and 56 aid in the proper positioning of two external actuator members 58 and 60, a portion of which may be introduced into the latch assembly 10 at the top and bottom thereof, respectively. In a preferred embodiment, each of the actuators 58 and 60 has a sandwich-like construction composed of a central rectangular-shaped portion 62 and two chevronshaped portions 64 located on either sides of portion 62. In operation, the central rectangular-shaped portion 62 is intended to be inserted into the open portion of the C-shaped housing between the parallel segments 66 and 68 thereof, and contact or engage the solid actuation portions 28*a–d* of latching arms 18*a* and *d* and 18*b* and *c*. Proper contact is insured via the triangular-shaped portion 70 of the chevron portions 64 fitting within the notch 54 located in both portions 66 and 68 at the "top" of the housing 12 and with the notch 56 located in both portions 66 and 68 at the "bottom" of the housing 12. Looking to FIG. 1, it may be seen that the actuator 60 has been inserted within the housing 12, and portion 70 has fit within the notch 56. Conversely, the actuator 58 in FIG. 1 has not been introduced within the housing 12.

Once insertion has begun, portion 62 of the actuator makes contact with the actuation portions 28*b* and *c* of the arms 18*b* and 18*c* and forces the arms (against the biasing of the extension springs) to their unlatched portions in which the roller engaging portions are rotated to a position in which they are within the confines of housing 12. The arms will remain in this unlatched position until the external actuator is withdrawn from the housing and the extension springs have moved the arms to their latched positions again.

Figure 5:
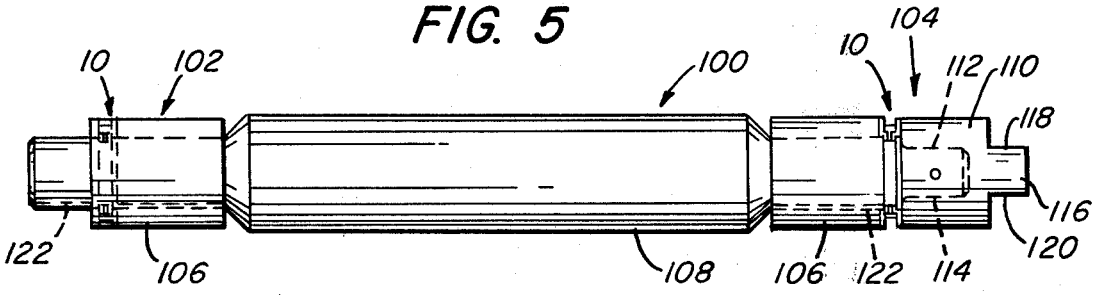
FIG. 5 is a plan view of the latch ring assembly of FIG. 1 in operational association with a plate mill stand roll and its supportive and drive members.

In order to facilitate in the removal of the latch assembly from the roll, a locking mechanism 72 is provided proximate arms 18*b* and *c* and a locking mechanism 74 is provided proximate arms 18*a* and *d*. The locking mechanisms 72 and 74 are comprised of two pairs of bores 76 and 78, respectively, formed in housing 12 proximate the solid actuation portions 28*a–d* of the latching arms as shown in FIG. 1. Each pair of bores 76 and 78, is located with respect to its associated arms such that they may receive externally actuated locking elements 80 and 82, respectively. The locking elements 80 and 82 are configured having support blocks 84 and 86, respectively, which have outwardly extending rods 88 and 90, and 92 and 94 associated therewith. In operation, the external actuators 58 and 60 are first introduced into housing 12 to move the arms 18*a* and 18*d* and 18*b* and 18*c*, respectively, to their unlatched positions, as exemplified by arms 18*b* and 18*c* in FIG. 1. Subsequently, the externally actuated locking elements 80 and 82 are introduced into the locking mechanisms 72 and 74 in order to lock the latching arms in their unlatched positions. This locking operation greatly facilitates the removal of the latching assembly from the mill roll. In this regard, reference is now made to FIG. 5 which shows a mill roll and associated support and drive elements according to the present invention.

A mill roll is shown generally at 100. The mill roll is configured having a central mill plate rolling portion 108 and necked-down end portions 102 and 104, which are employed, in part, to support the roll 100 for rotation about its longitudinal axis. End 104 is additionally employed as a driving end for the roll 100. Each end 102 and 104 of roll 100 has an associated chock or bearing housing 106 which is slipped on respective ends of the roll 100 for supporting its above-noted rotation. A drive pod, shown generally at 110, is configured to slip on end 104 of roll 100 for providing a convenient rotational interface between roll 100 and a source of rotational energy (not shown). The pod 110 has in the past been normally retained on the roll through the employment of a quarterturn pin (not shown) and flats 112 and 114, located on opposite sides of the end portion 104. In turn, drive pod 110 includes an extension portion 116 having two opposed flats 118 and 120 located thereon which are used for facilitating the rotation of the drive pod 110.

The necessity of providing a more convenient chock and drive pod latch assembly for use with a mill plate work roll becomes apparent when the size of the pieces is understood. The work rolls upon which the present latch assembly is employed are approximately 30 inches in diameter and are over 20 feet long weighing approximately 45,000 pounds. Moreover, each chock weighs approximately 4500 pounds while the drive pod approaches 3700 pounds. Accordingly, the less these large pieces are handled, the less likelihood there is for accidents or injuries to the workmen employed in removing and replacing the chocks and drive pod on the work roll.

As noted previously, the specific roll engaging portions 32*a–d* of the latching arms are configured to engage a circumferal groove formed on the end portions 102 and 104 of the work roll 100 such that the latch arrangement and the chock which it is holding do not slip off the roll. In addition, a key 120 is provided on the inner wall 36 which cooperates with a keyway 122 formed on each end 102 and 104 of the work roll for retaining the latch assembly on the roll in a given orientation without independent rotation with respect to the roll. It is this orientation which is required in order to permit the proper mechanical removal of the latch assembly from the work roll prior to regrinding procedures.

Figure 3:
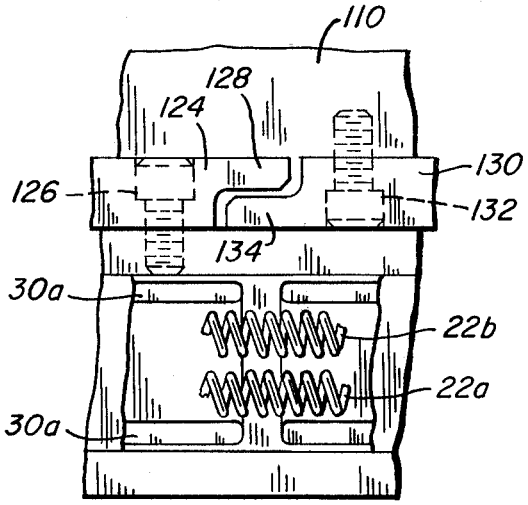
FIG. 3 is a side elevational view of the latch ring assembly of FIG. 1.

In addition to securing the chocks upon the work roll, the latch assembly of the present invention provides for the retention of the drive pod upon the work roll without the necessity of a quarter-turn pin or the like. Specifically, the latch assembly 10 includes a pair of lugs, one of which is shown at 124, which are mounted opposite each other on the exterior of portion 68 of housing 12 (see FIGS. 2 and 3). The lug 124 of latch assembly 10 is mounted to portion 68 by bolts, or the like, one of which is shown at 126, and is positioned such that an extension 128 is parallel to, but spacially removed from, the portion 68. Similarly, the end portion of the drive pod which abuts latch assembly 10 is provided with a pair of oppositely mounted lugs, one of which is shown at 130. The lugs 130 are mounted to the end of drive pod 110 through bolts 132, and are positioned such that an extension 134, formed as a portion thereof, is parallel to the portion 68 and is engageable with the extension 128 of lug 124 in the manner shown in FIG. 3. As a result of this lug extension engagement, whereby each is "captured" by the other, the drive pod is secured to the assembly 10, and consequently, onto the work roll 100. The "capturing" is accomplished by a lateral motion of the drive pod relative to the latch assembly prior to placing both on the work roll.

As a result of the employment of the present latch assembly on the work roll, the need for workmen to manually remove the three separate sections of the old split ring assembly is eliminated. The invention might preferably employ a machine having externally actuated locking elements 80 and 82 located thereon, thereby obviating the need for further manual work. Moreover, the present latch assembly utilizes the rotation of the work roll to create a latching situation in which the retention forces exerted by the latch assembly are increased as the rotational speed of the work roll is increased, thereby creating a more efficient as well as safer operation.

While certain changes may be made in the above apparatus without departing from the scope of the invention herein involved, it is intended that all matter contained in the above description or shown in the accompanying drawings shall be interpreted as illustrative and not in a limiting sense.

I claim:

1. A latch ring chock retainer assembly for a roll having a circumferal groove formed therein, said latch ring assembly comprising:

a housing including means defining an aperture formed through the center thereof, said aperture having a diameter such that said housing is capable of fitting over an end of such roll;

a plurality of latching arms mounted to said housing, said latching arms being movable between a latched position, in which a portion of said latching arm engages such circumferal groove in such roll, and an unlatched position in which said portion of said latching arm is moved out of engagement with such roll groove; and means for biasing said latching arms toward their said latched positions.

2. The latch ring chock retainer assembly according to claim 1 in which said biasing means are extension springs.

3. The latch ring chock retainer assembly according to claim 1 in which said biasing means are extension springs, said extension springs extending between one and another of said latching arms for biasing said latching arms into their latched positions.

4. The latch ring chock retainer assembly according to claim 1 in which means are provided for pivotally supporting said latching arms on said housing, each of said latching arms being pivotally supported at a point located between said portion of said latching arm engageable with such circumferal groove and the center of gravity of said latching arm such that center of gravity of said latching arm is centrifugally moved outwardly and said circumferal groove engaging portion of said latching arm is centrifugally moved further into engagement with such circumferal groove when said latch ring assembly is rotated along with such roll.

5. The latch ring chock retainer assembly according to claim 4 in which said biasing means are extension springs, said extension springs extending between one and another of said latching arms for biasing said latching arms into their latched positions, said extension springs being attached to each of said one and said another latching arms at points on each located substantially between said circumferal groove engaging portion and the center of gravity of each of said latching arms.

6. The latch ring clock retainer assembly according to claim 1 in which said latching arm includes means for receiving an external actuating member for pivotally moving said circumferal groove engaging portion from a position in which it is in engagement with such circumferal groove to a portion in which it is out of engagement with such circumferal groove, thereby facilitating the removal of said latch ring assembly from such roll.

7. A latch ring chock and drive pod retainer assembly for use with a finishing stand roll having a chock at each of its ends and a drive pod at one of its ends and having a circumferal groove formed at each end, said latch ring assembly retaining said chocks and said drive pod on their respective ends of said roll, said latch ring assembly comprising:

a generally toroidal shaped housing having an inner diameter larger than the outer diameter of the roll end such that said assembly is capable of fitting over such roll end, said housing including means defining a pair of slots oppositely oriented on the inner diameter of said housing;

a series of two pairs of latching arms pivotally mounted within said housing, each of said pair of latching arms being movable simultaneously between a latched position, in which a portion of each of said pair of latching arms extends inwardly of the inner diameter of said housing through one of said slots to engage such circumferal groove in such finishing roll, and an unlatched position in which said circumferal groove engaging portion of each of said pair of latching arms is retracted within said housing through one of said slots to a position exteriorly of said inner diameter of said housing and out of engagement with such finishing roll circumferal groove; and extension spring means associated with each of said pairs of latching arms and extending between each latching arm of said pair for biasing each pair of said latching arms toward their latched positions.

8. The latch ring chock and drive pod retainer assembly of claim 7 in which said assembly further includes means for receiving an externally actuated locking member for selectively retaining said latching arms in their unlatched positions subsequent to their movement to said unlatched positions.

9. The latch ring chock and drive pod retainer assembly of claim 7 in which latch means are provided on said latch ring assembly housing for cooperating with similarly shaped elements on such drive pod, said latch means of said assembly and said similarly shaped elements on such drive pod being configured to engage each other and latch said latch assembly and said drive pod to each other.

* * * * *

UNITED STATES PATENT OFFICE

CERTIFICATE OF CORRECTION

Patent No. 4,000,638 Dated January 4, 1977

Inventor(s) McKinley B. Thomas

It is certified that error appears in the above-identified patent and that said Letters Patent are hereby corrected as shown below:

Column 1, line 46, "clock" should read -- chock --.

Column 4, line 51, "appopriately" should read -- appropriately --.

Column 8, line 1, claim 6, "clock" should read -- chock --.

Signed and Sealed this

Tenth Day of May 1977

[SEAL]

*Attest:*

RUTH C. MASON
*Attesting Officer*

C. MARSHALL DANN
*Commissioner of Patents and Trademarks*